US010179265B2

(12) United States Patent
Carr

(10) Patent No.: US 10,179,265 B2
(45) Date of Patent: Jan. 15, 2019

(54) EXERCISE APPARATUS USING CONSTANT VELOCITY RESISTANCE TRAINING

(71) Applicant: Jordan Carr, Cornelius, OR (US)

(72) Inventor: Jordan Carr, Cornelius, OR (US)

(73) Assignee: Jordan Carr, Kennewick, WA (US)

( * ) Notice: Subject to any disclaimer, the term of this patent is extended or adjusted under 35 U.S.C. 154(b) by 0 days.

(21) Appl. No.: 15/170,527

(22) Filed: Jun. 1, 2016

(65) Prior Publication Data

US 2016/0354638 A1 Dec. 8, 2016

Related U.S. Application Data

(60) Provisional application No. 62/170,449, filed on Jun. 3, 2015.

(51) Int. Cl.
*A63B 21/00* (2006.01)
*A63B 21/005* (2006.01)
(Continued)

(52) U.S. Cl.
CPC ..... *A63B 24/0087* (2013.01); *A63B 21/0059* (2015.10); *A63B 21/4043* (2015.10); *A63B 21/062* (2013.01); *A63B 21/153* (2013.01); *A63B 21/154* (2013.01); *A63B 21/156* (2013.01); *A63B 21/157* (2013.01); *A63B 21/1636* (2013.01); *A63B 21/1654* (2013.01); *A63B 21/4029* (2015.10); *A63B 21/4035* (2015.10); *A63B 23/03525* (2013.01);
(Continued)

(58) Field of Classification Search
CPC ..... A63B 24/0087; A63B 24/0093; A63B 21/002; A63B 21/0023; A63B 21/0058; A63B 21/153; A63B 21/154; A63B 21/157; A63B 21/15; A63B 21/151; A63B 21/152; A63B 21/4043; A63B 21/4049; A63B 21/0059
See application file for complete search history.

(56) References Cited

U.S. PATENT DOCUMENTS 3,869,121 A * 3/1975 Flavell ..... A61B 5/22 482/2
4,184,687 A * 1/1980 Wren ..... G11B 3/08512 318/600
(Continued)

*Primary Examiner* — Nyca T Nguyen
(74) *Attorney, Agent, or Firm* — Compass IP Law PC

(57) ABSTRACT

Exercise equipment provides maximum effort repetitions, every rep, safely, through constant velocity. With constant velocity resistance, every person using the equipment can achieve maximum resistance for each repetition, whether their strength maxes out at 5 lbs. or 500 lbs. of resistance. The constant velocity resistance allows for reduced resistance with each repetition as fatigue sets in, without changing the equipment settings. The exercise equipment includes a line coupled to a handle, and retracted by a retraction assembly. An impeder provides resistance for pushing/pulling (depending on the exercise) based on constant rotational velocity of the impeder, rather than resisting with a force of gravity, spring force, or friction. The impeder prevents extraction of the line faster than the constant rotational velocity. Thus, a user can push/pull as hard as desired, and the line can only be extracted as limited by the velocity of the impeder.

13 Claims, 7 Drawing Sheets

(51) Int. Cl.

| | |
|---|---|
| ***A63B 24/00*** | (2006.01) |
| *A63B 69/00* | (2006.01) |
| *A63B 21/062* | (2006.01) |
| *A63B 21/16* | (2006.01) |
| *A63B 23/035* | (2006.01) |
| *A63B 23/12* | (2006.01) |
| *A63B 71/00* | (2006.01) |

(52) U.S. Cl.
CPC ..... *A63B 23/1209* (2013.01); *A63B 69/0048* (2013.01); *A63B 2024/0093* (2013.01); *A63B 2071/0072* (2013.01); *A63B 2071/0081* (2013.01); *A63B 2220/30* (2013.01); *A63B 2220/34* (2013.01); *A63B 2220/54* (2013.01)

(56) References Cited

U.S. PATENT DOCUMENTS 4,261,562 A * 4/1981 Flavell ..... A63B 21/0053 482/6
4,848,152 A * 7/1989 Pratt, Jr. ..... A63B 21/4005 482/6
4,869,497 A * 9/1989 Stewart ..... A63B 21/00178 482/5
5,433,678 A * 7/1995 Chi ..... A63B 21/0058 482/1
6,267,709 B1 * 7/2001 Jacques ..... A63B 21/00181 482/1
7,682,287 B1 * 3/2010 Hsieh ..... A63B 21/00196 482/1
8,333,681 B2 12/2012 Schmidt
8,968,155 B2 3/2015 Bird
9,700,753 B1 * 7/2017 Boatwright ..... A63B 21/153
9,833,662 B2 * 12/2017 Potter ..... A63B 24/0087
2003/0069112 A1 * 4/2003 Williams ..... A63B 21/154 482/101
2008/0300118 A1 * 12/2008 Wehrell ..... A63B 21/04 482/129
2012/0053014 A1 * 3/2012 Zhu ..... A63B 21/00069 482/5
2013/0310230 A1 * 11/2013 Norris ..... A63B 21/018 482/115
2014/0038777 A1 * 2/2014 Bird ..... A63B 21/0058 482/5
2014/0113779 A1 * 4/2014 Loach ..... A63B 21/0004 482/115
2015/0258361 A1 * 9/2015 Xie ..... A63B 21/153 482/98
2015/0273266 A1 10/2015 Lo et al.

* cited by examiner

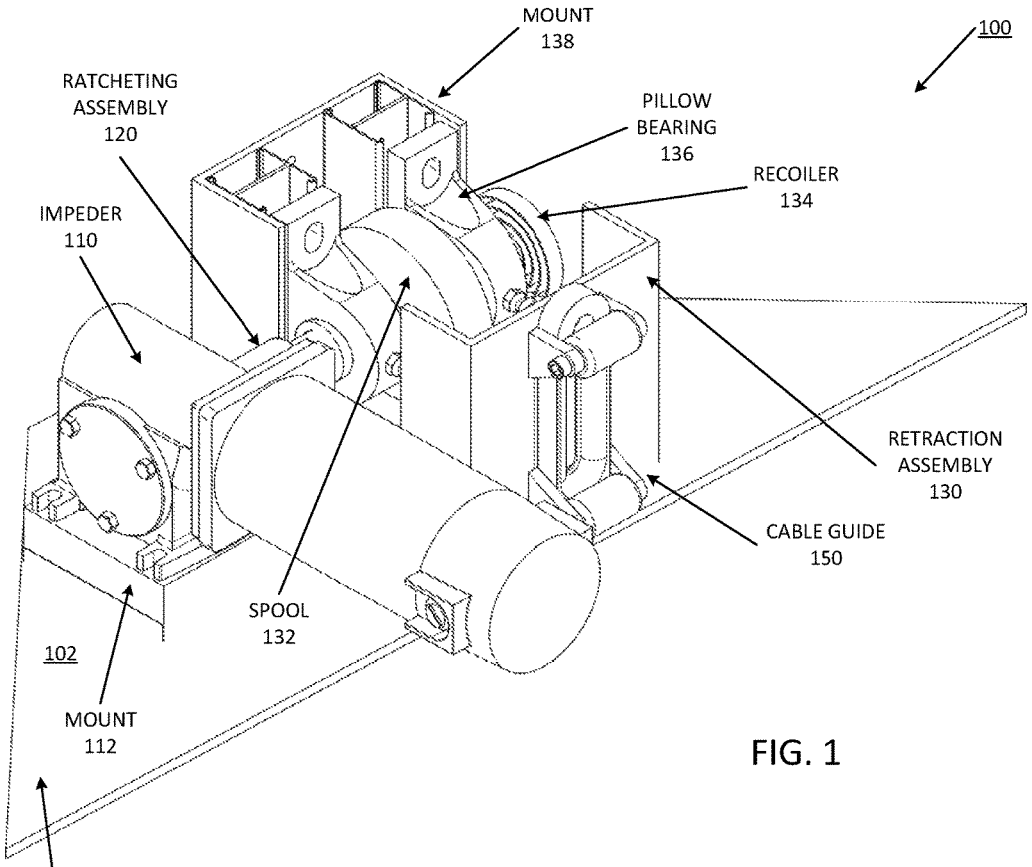
FIG. 1
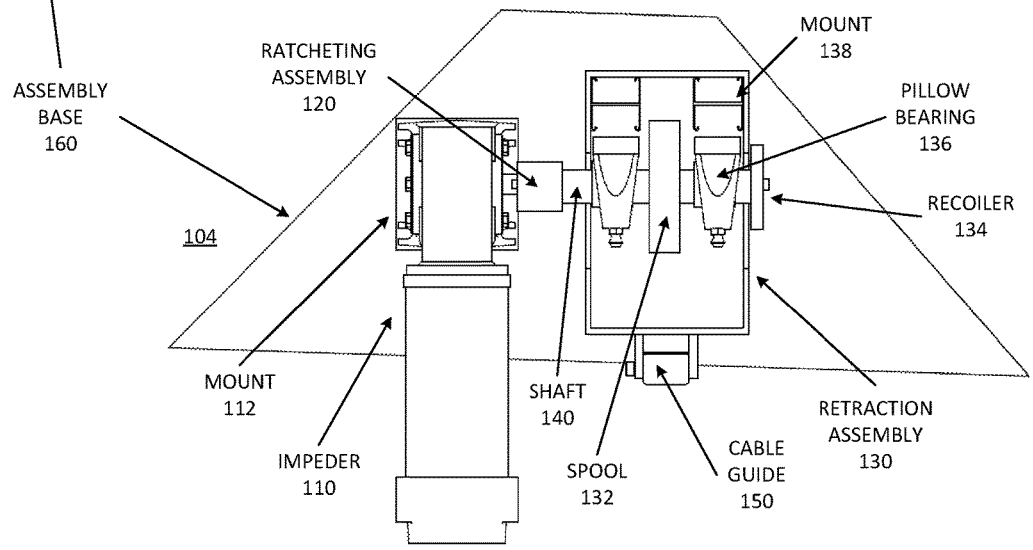

FIG. 8
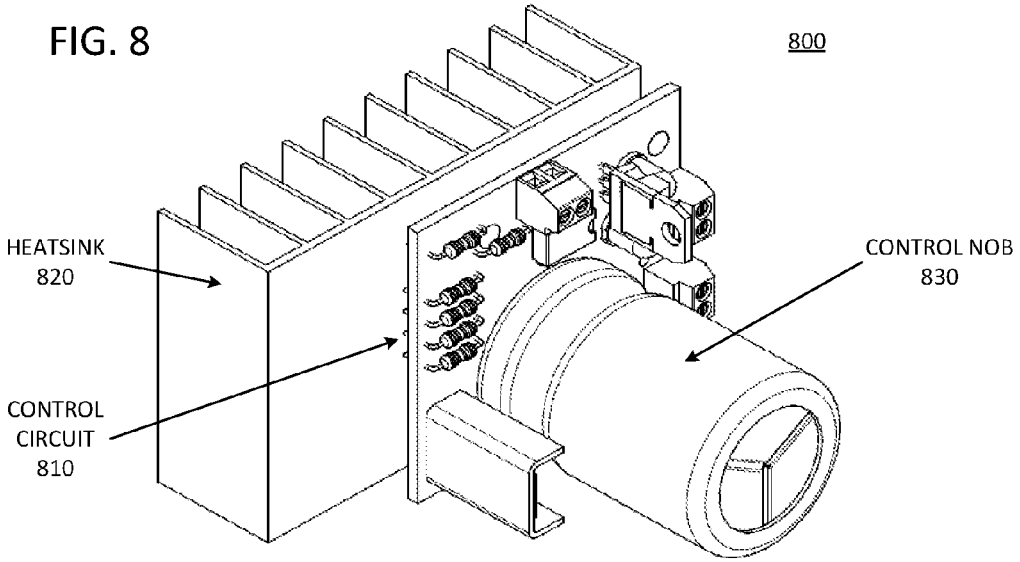
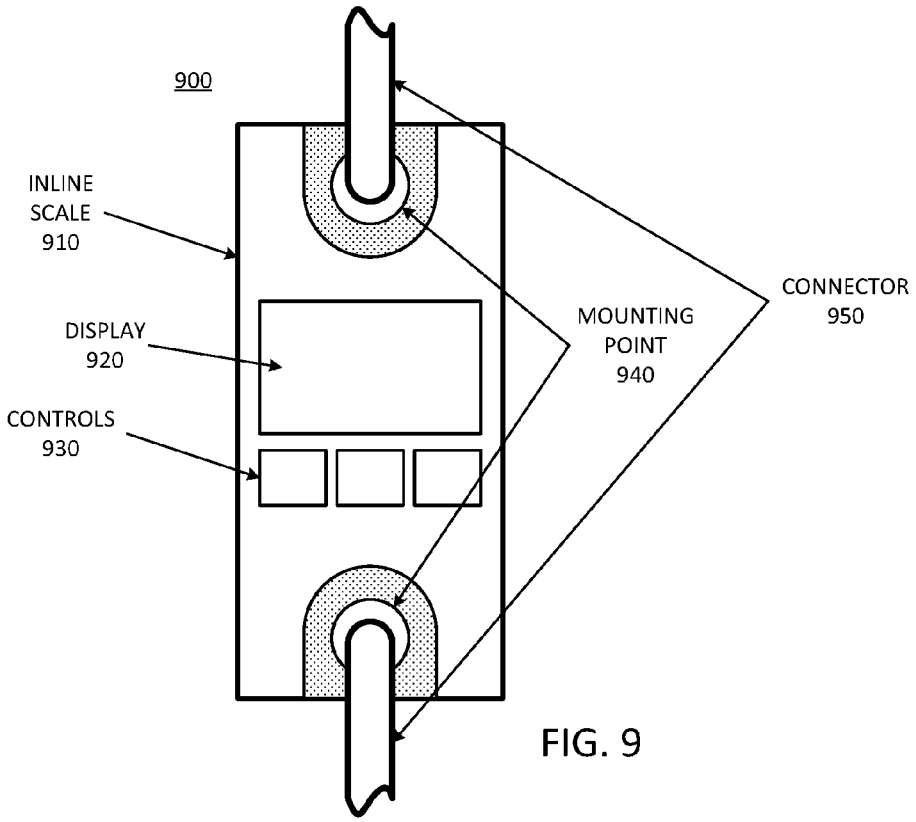
FIG. 9

EXERCISE APPARATUS USING CONSTANT VELOCITY RESISTANCE TRAINING

RELATED CASE

The present application is a non-provisional application based on U.S. Provisional Patent Application Ser. No. 62/170,449 filed Jun. 3, 2015, and claims the benefit of priority of that application. The provisional application is hereby incorporated by reference.

FIELD

Descriptions herein are generally related to providing resistance for exercising, and more specific descriptions are related to exercise equipment that can provide resistance and resistance training based on a constant velocity impeder.

COPYRIGHT NOTICE/PERMISSION

Portions of the disclosure of this patent document can contain material that is subject to copyright protection. The copyright owner has no objection to the reproduction by anyone of the patent document or the patent disclosure as it appears in the Patent and Trademark Office patent file or records, but otherwise reserves all copyright rights whatsoever. The copyright notice applies to all data as described below, and in the accompanying drawings hereto, as well as to any software described below: Copyright © 2015 and 2016, Jordan Carr. All Rights Reserved.

BACKGROUND

Conventional resistance training uses static resistance, creating a point of fatigue, or point when the movement cannot be continued. Conventional resistance training relies on the application of the force of gravity (e.g., free weights) or friction (e.g., spinning wheel trainers) or spring force (e.g., bands or rods) to provide resistance. The number or repetitions of a movement a user can perform is gated to when the muscles fatigue at the specific, static resistance. The number of repetitions sought for training, traditionally, is directly related to the amount of the resistance, dividing the goals of weight training into three categories: gain strength, gain muscle mass, and increase the ability to inflame the muscle. Traditionally high weight and low (<8) repetitions (reps) are used to gain strength. The use of high weight can significantly increase the risk of injury. The risk of injury can be reduced by use of a spotter, but even with the spotter the risk of injury typically remains high.

Moderate weight for a moderate number of reps (8-12) is typically used to focus on muscle building. Moderate weight tends to reduce the risk of injury, but only engages the muscles at a percentage of their capacity. Engaging muscles at less than full capacity provides muscle building inefficiency, which requires additional time, sets, and lift variations to achieve the desired result. Low weight and high reps (12+) is typically used to focus on increasing the ability for the muscle to inflame. The ability of the muscle to inflame is generally used for endurance training. With low weight, the marginal use of capacity is exaggerated, causing even longer durations of the workouts.

Within all three methods, traditional weight training with static resistance has several disadvantages. One disadvantage is that conventional resistance training requires a plethora of weighted objects, locations, settings, and multiple separate mechanisms and stations to accomplish resistance training for all muscle groups. Another disadvantage is that conventional resistance training equipment is bulky, heavy, unsafe, and requires a lot of space, or is smaller but with limited efficiency. Another disadvantage is that conventional resistance training equipment is not suited to all ages or health conditions. Most equipment focuses on very specific muscle sets, increasing the amount of time needed to exercise many muscle groups, and reducing the ability to gain functional strength. Another disadvantage is when multiple people are sharing equipment, or a single person is rotating regiments. Every switch traditionally requires individual adjustments and repeatedly resetting weights, which can be unsafe, time consuming, and un-motivating.

All of these factors with traditional resistance training are cumbersome, less efficient, increase the probability of injury, slow the workout, limit resources, and increase maintenance costs.

BRIEF DESCRIPTION OF THE DRAWINGS

The following description includes discussion of figures having illustrations given by way of example of implementations of embodiments described. The drawings should be understood by way of example, and not by way of limitation. As used herein, references to one or more "embodiments" are to be understood as describing a particular feature, structure, or characteristic included in at least one implementation. Thus, phrases such as "in one embodiment" or "in an alternate embodiment" appearing herein describe various embodiments and implementations, and do not necessarily all refer to the same embodiment. However, they are also not necessarily mutually exclusive.

FIG. 1 is a representation of an embodiment of a resistance assembly that provides resistance via a constant velocity impeder.

FIG. 8 is a representation of an embodiment of a speed control unit for a resistance training assembly that provides resistance via a constant velocity impeder.

FIG. 9 is a representation of an embodiment of a resistance display for a resistance training assembly that provides resistance via a constant velocity impeder.

Figure 2:
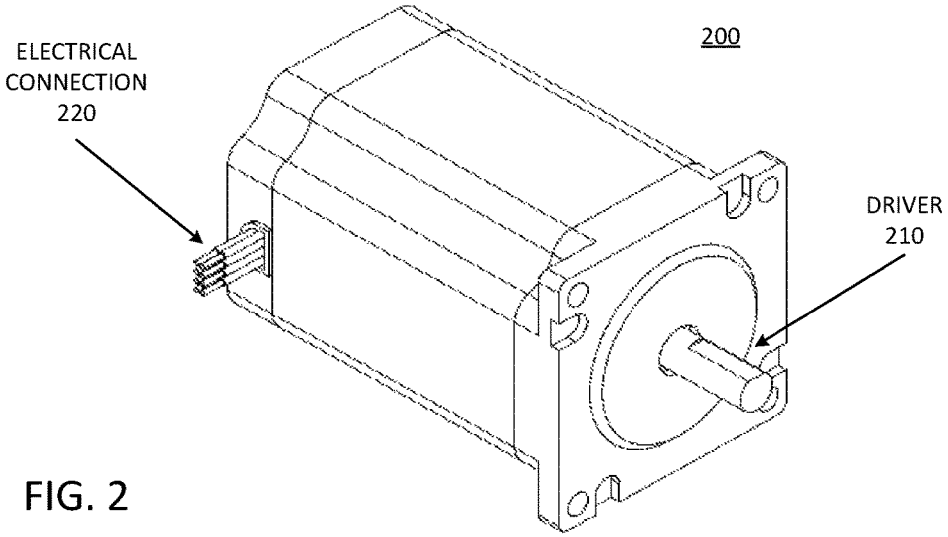
FIG. 2 is a representation of an embodiment of an impeder motor for a resistance assembly.

Descriptions of certain details and embodiments follow, including a description of the figures, which can depict some or all of the embodiments described below, as well as discussing other potential embodiments or implementations of the inventive concepts presented herein.

DETAILED DESCRIPTION

As described herein, exercise equipment provides resistance based on constant velocity instead of the force of gravity, friction, or spring force. The exercise equipment includes an impeder to provide the resistance, where the impeder impedes extraction of a line. The impeder limits the extraction of the line to a constant velocity regardless of force applied. Thus, the extraction of the line is based on a constant rotational velocity, based on a torque of the impeder instead of based on force applied by the person using the equipment. With such an impeder, multiple users can use the same equipment in succession without changing the setup of the equipment and engage their muscles at peak capacity for every repetition (rep). Exercise type, and even form of the exercise, can vary drastically with limited risk of injury since the human body will typically limit its own application of force to reduce injury. Thus, not only is the convenience of exercise improved, but the range of types of possible exercises is increased, all while providing a low risk exercise experience for the user. A further use of such an impeder is as a rock climbing belay, where a climber can climb as a rope or cable is retracted, and a fall will be impeded to allow the user to fall no faster than a constant velocity set for the equipment. Other uses and applications will be understood by those skilled in the art.

Exercise equipment with such an impeder provides maximum effort repetitions, every rep, safely, through constant velocity. Constant velocity resistance allows every user to achieve maximum resistance for each repetition, whether their strength maxes out at 5 lbs. or 500 lbs. of resistance. In effect, the user provides the resistance by the application of force, because with the constant velocity, the impeder merely needs to be designed with enough torque to avoid breakdown against a theoretical maximum amount of force the strongest user could apply. With such a constraint, the impeder essentially becomes an "immovable object" that is moving at a set speed, and any application of force will work out the user's muscles without changing the speed of movement. Thus, even within a set of reps for a given exercise, the amount of resistance can change as a user fatigues and is able to apply less resistance. Rather than risking injury due to fatigue, the user can continue indefinitely applying peak capacity of the muscles even as that capacity reduces.

Exercise equipment with an impeder can include a line coupled to a handle, and retracted by a retraction assembly. The impeder provides resistance for pushing/pulling (depending on the exercise) based on constant rotational velocity of the impeder, rather than resisting with a force of gravity, friction, or spring force. The impeder prevents extraction of the line faster than the constant rotational velocity. Thus, a user can push/pull as hard as desired, and the line can only be extracted as limited by the velocity of the impeder.

Figure 6:
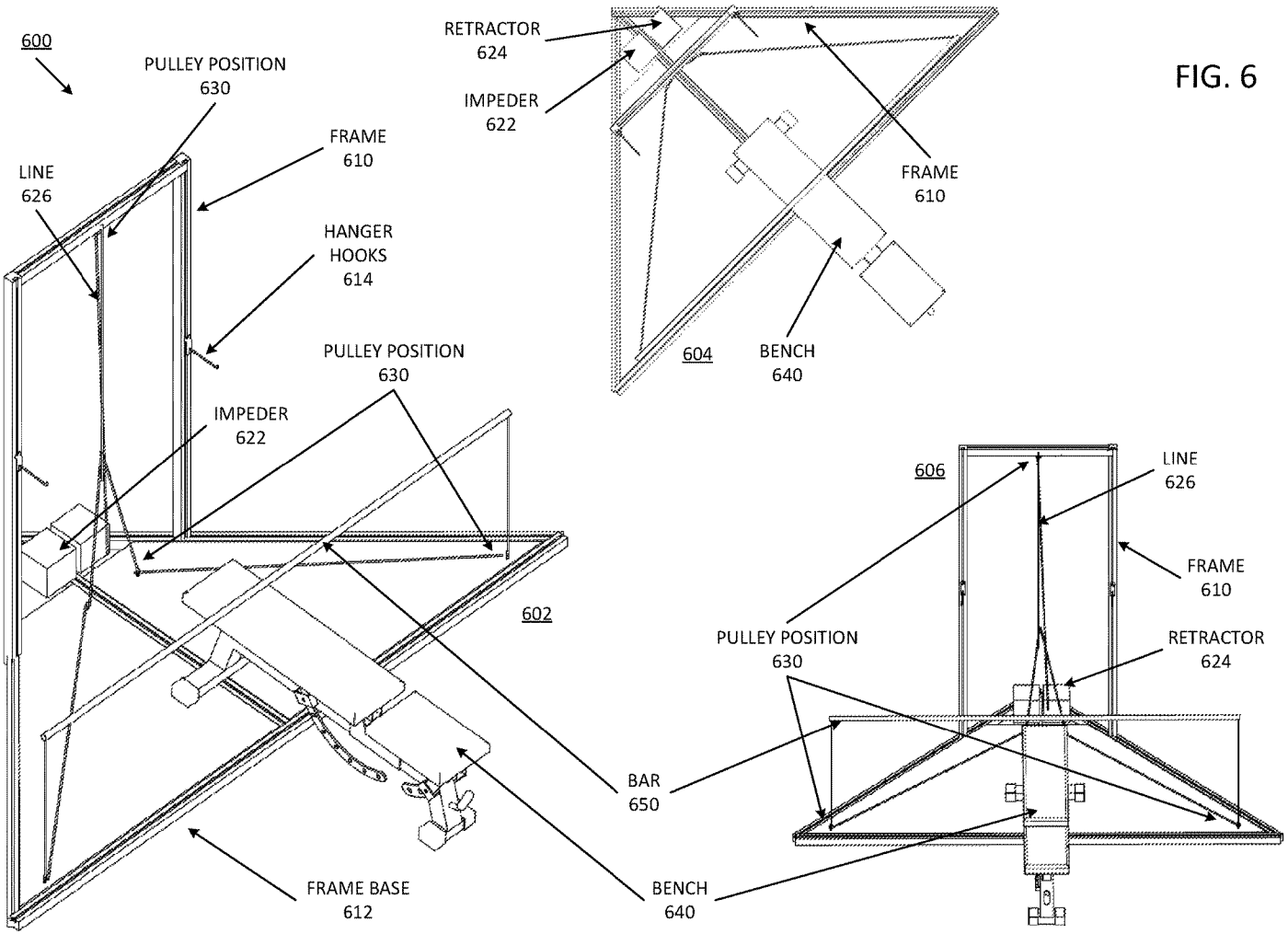
FIG. 6 is a representation of an embodiment of a frame for a resistance training assembly that provides resistance via a constant velocity impeder, with pulleys to enable use of a workout bench.

FIG. 1 is a representation of an embodiment of a resistance assembly that provides resistance via a constant velocity impeder. Assembly 100 represents exercise equipment with an impeder in accordance with an embodiment described above. The exercise equipment can be incorporated into an exercise training system (such as illustrated in FIG. 6), or in a belay system. Assembly 104 represents assembly 102 at a top view, looking down on the equipment. Reference numerals and labels are repeated to show the different components from different perspectives.

Impeder 110 provides the resistance for assembly 100. Impeder represents a mechanism that provides a constant rotational velocity for a line. The rotational velocity refers to a device that rotates and spins, and will spin a shaft or axel or a driver at a constant number of revolutions per time interval. It will be understood that the precision of the number of revolution per time interval may vary depending on the type of apparatus used to implement the impeder. The constant velocity or fixed velocity refers to a rotational velocity within a tolerance for the given impeder apparatus. In one embodiment, impeder 110 is or includes an electric motor geared through a mechanical application, such as a gear box reduction system or belt and pulley system, to produce sufficient torque that exertion applied by the user is unable to alter the speed of the motor.

Impeder 110 can mount to assembly base 160 via mount 112. Assembly base 160 represents a base or platform on which the components of assembly 100 can be connected to each other. Assembly base 160 can include a frame, a board, a metal plate, resin or composite material, plastics, or other material, or a combination.

Assembly 100 includes retraction assembly 130 coupled to impeder 110 via ratcheting assembly 120. Ratcheting assembly 120 represents a mechanical coupling between impeder 110 and retraction assembly 130 that allows impeder 110 to rotate in a direction of extraction of the line from retraction assembly 130, but does not permit the impeder to impede the retraction of the line by retraction assembly 130. Thus, impeder 110 drives a mechanism coupled to the line in a direction of extraction. Extraction moves in a direction of rotation of impeder 110, and thus impeder 110 limits the speed of extraction to the constant rotational velocity. When a user ceases to apply force to the line, retraction assembly 130 retracts or recoils the line, and ratcheting assembly 120 spins freely against impeder 110. Thus, ratcheting assembly 120 engages or ratchets in the direction of rotation of impeder 110, and spins freely against the direction of rotation of impeder 110.

In one embodiment, retraction assembly 130 includes spool 132 on which the line is wound. Thus, in one embodiment, extraction in response to application of force by a user draws the line out from spool 132, and retraction assembly 130 rewinds the line on spool 132. In one embodiment, retraction assembly 134 includes a recoil spring or other recoiler 134 to hold the line in tension, trying to draw the line back in or retract the line.

In one embodiment, retraction assembly 130 includes a housing or other mechanical structure to contain the elements of retraction assembly 130. In one embodiment, such a housing is secured to assembly base 160, and can secure assembly 100 to a frame. In one embodiment, assembly 100 secures to a frame via assembly base 160. In one embodiment, alternatively to securing via assembly base 160, or in addition, mounts 138 of retraction assembly can secure to a frame. In one embodiment, retraction assembly 130 includes pillow bearings 136, which can couple the securing mounts 138 to shaft 140 or an axel, or provide other mechanical coupling of the mounts to the retraction assembly and impeder.

In one embodiment, ratcheting assembly 120 couples impeder 110 to retraction assembly 130 via shaft 140, which can turn relation to the rotation of impeder 110. In one embodiment, spool 132 can be directly secured to shaft 140, allowing the extraction and retraction operation as described above. Shaft 140 can continue through retraction assembly 130 as illustrated, to recoiler 134.

As mentioned previously, assembly 100 couples to a line to which a user can apply force. Impeder controls extraction of the line to the rotation velocity, regardless of force applied by the user. In one embodiment, retraction assembly 130 includes cable guide 150 to act as a guide for the line. Cable guide 150 can align the line for retraction. Cable guide 150 can also direct the line to one or more connection points to connect to a component a user grips or wears to apply force to extract the line.

In one embodiment, impeder 110 includes an electric motor, which requires power to operation. In such an embodiment, a user can operation assembly 100 by electrically connecting impeder 110 to a power source, such as a wall outlet, a generator, a battery pack, or other power source. The user can adjust connections to the line in accordance with preferences for the training or activity desired, and begin exercising.

As mentioned above, exercise equipment that includes assembly 100 can provide maximum effort repetitions for every rep through constant velocity, while maintaining safety for the user. With impeder 110, the resistance provided by assembly 100 is independent of the user or exerciser, because it is based upon the velocity of the movement and not the resistance. Regardless of maximum capacity of the user, the velocity of impeder 110 remains the same, thus separating the resistance and the user. The only strength requirement to continue on to the next repetition is the strength to engage the ratcheting assembly 120, which is varied by recoiler 134. In one embodiment, the recoiler can be turned down to make a point of fatigue negligible.

It will be understood that assembly 100 in an exercise routine allows for all types of muscle groups to be worked to their full capacity, through their full range of motion by one piece of equipment, without changing weights. In one embodiment, one or both of the speed of impeder 110 or the strength of recoiler 134 is variable. Variable control enables assembly 100 to be set to the preference of the exerciser. More detail is set forth below with respect to FIGS. 8 and 9.

In one embodiment, assembly 100 is incorporated into a strength training apparatus. A strength training apparatus can include any type of exercise equipment for resistance training with which a user increases strength or physical fitness. Strength training is not necessarily limited to a specific muscle group, nor does it necessarily have to include any particular muscles groups. It is contemplated that assembly 100 can be incorporated into many different types of equipment to build muscle, endurance, improve muscle mass, improve body leanness, or other types of equipment, or a combination. Exercise equipment can include equipment for beginners, or equipment for those more experienced with strength training. Exercise equipment can include physical therapy equipment to facilitate recovery from injury or accident. In one embodiment, assembly 100 is incorporated into equipment for use in exercise, where the equipment provides a safety feature. For example, as already mentioned, assembly 100 could be incorporated into a belay system, where the assembly can prevent falling at the acceleration of gravity, but allow a climber to climb. Other uses of belay or safety equipment can also be included in accordance with an embodiment herein.

When incorporated into strength training equipment, assembly 100 provides resistance perfectly suited to each user, and provide a perfect maximum effort repetition for desired results of any muscle group, all at one station. Assembly 100 provides exercise equipment that is compact, safe, efficient, and low cost to maintain. Experiment has shown that the equipment is easy to use for all ages and for all skill levels. Even young users who are not familiar with good form or practices can enjoy using such exercise equipment, without risk of injury. The inventor also found that he was able to improve lean muscle mass by approximately 20 percent in the course of just a matter of months, without ever working out longer than 45 minutes to an hour per day. Most intriguing to the inventor is that with such exercise equipment he did not experience the typical soreness and tightness normally associated with strength training, even while significantly increasing lean muscle mass. While it is not well understood how the exercise equipment enables the increase of muscle mass without soreness, the inventor has experienced such results firsthand and secondhand.

As previously mentioned, resistance provided by assembly 100 is based on the velocity of the movement, rather than the force of gravity or other resistive force. The velocity at which the line can be extracted is the same regardless of force applied to the line via a bar or strap or stirrup. With the velocity constant regardless of force applied by the user, the force applied by the user becomes the resistance for the exercise. Such a feature allows the user to apply as much force as they desire or are able. If the user applies full effort, the muscle groups exercised will be strained at their maximum capacity through the full range of motion. This eliminates the possibility of overexertion by weights that exceed the capacity of the user, which lead to injury, and allows the application of different amounts of force at different positions in the full range of motion, consistent with natural body movement. With velocity constant in the motion, the risk of injury is either eliminated or significantly reduced. No risk of injury with the exercise equipment is known. Consider the example of bench pressing: when bench pressing with free weights if a lifter is injured during the lift, or fatigues under the weight, the consequence is what gravity dictates. In contrast, when bench pressing with exercise equipment based on assembly 100 where there are no free weights involved, when the lifter fatigues, there is no standing weight to crush them. Despite the lack of standing weight to crush the lifter, the lifter can apply the same amount of force to exercise equipment with assembly 100 as to free weights. A way to illustrate this principle is to understand the difference between someone pushing a car that is moving very slowly away at a set speed, versus trying to stop the car from moving toward them. With a car moving away from the person, stopping pushing is not dangerous, whereas with a car moving toward them, ceasing effort to resist the car or lacking strength to stop will both result in the person being crushed.

FIG. 2 is a representation of an embodiment of an impeder motor for a resistance assembly. Motor 200 provides one example of a constant-motion impeder mechanism. In one embodiment, motor 200 includes a DC (direct current) motor. In one embodiment, motor 200 includes an AC (alternating current) motor. In one embodiment, motor 200 includes a pneumatic pump. In one embodiment, motor 200 includes an air operated rotor. In one embodiment, motor 200 includes a flywheel. In one embodiment, motor 200 includes a hydraulic motor. Other mechanisms are possible. In general, motor 200 provides a torque to allow extraction of a line from a retraction assembly at a constant velocity. Thus, the line will be extracted from the retraction assembly at a constant speed.

In operation, motor 200 can be plugged in or otherwise powered, and activated by switch or comparable mechanism. In one embodiment, motor 200 includes variable speed control as described in more detail with respect to FIG. 8. It will be understood that reference to a constant speed or a fixed velocity refers to the speed at which motor 200 is set to operate for one or more repetitions of an exercise. Thus, for different exercise types or for different people, motor 200 can be set to a different speed, but then the user will operate the exercise equipment with the motor at that setting, and the motor will provide constant velocity at that setting. Thus, the use of a variable motor does not in itself mean that the velocity is not constant for use in exercise. Such a motor with variable speed control is simply capable of a range of different constant speeds, which will be set for use in the exercise.

In one embodiment, motor 200 includes driver 210 or shaft 210, which spins or rotates when the motor is operational. Motor 200 in general includes a driving mechanism to cause the transfer of the torque generated by the motor to a line in the exercise equipment. The coupling of the motor to the line can be direct or indirect. In one embodiment, motor 200 includes electrical connection 220 to provide power to the motor.

Figure 3:
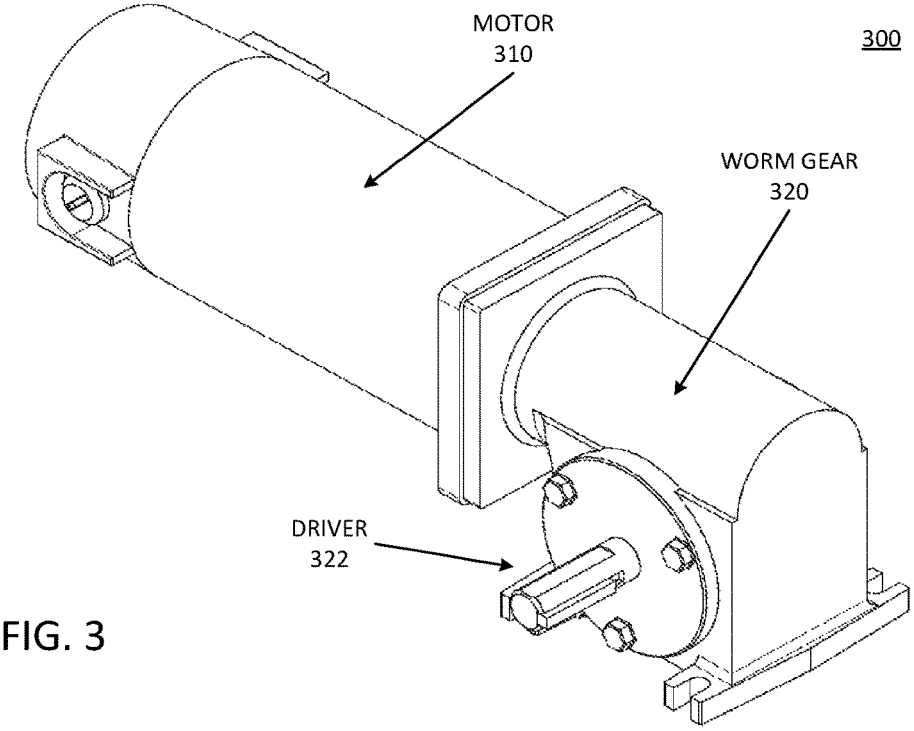
FIG. 3 is a representation of an embodiment of a one-way drive for an impeder for a resistance assembly.

FIG. 3 is a representation of an embodiment of a one-way drive for an impeder for a resistance assembly. Assembly 300 includes motor 310, which can be any type of motor 200 as referred to in FIG. 2. In one embodiment, assembly 300 can be referred to as a drive assembly. In one embodiment, assembly 300 includes worm gear 320 to increase the torque output of motor 310. While a worm gear is a specific mechanical component, it will be understood that assembly 300 can be modified with one or more other mechanical apparatuses to provide the torque magnification of worm gear 320. In one embodiment, worm gear 300 magnifies the torque of motor 310 by causing a higher-rotation of a driver of motor 310 to result in a lower-rotation at driver 322 of worm gear 320 (i.e., the output).

A worm gear refers to a mechanism where a "screw" portion of threading engages or meshes with a gear (respectively referred to as the worm and the worm wheel or worm gear) that will spin at a much slower speed than the shaft that screw is a part of. It will be understood that alternatively to a specific worm gear component, assembly 300 can include a system of pulleys or gears or other mechanisms or a combination that has an input mechanism to operate at one rotational velocity, and produce an output with a lower rotational velocity. Worm gear 320 provides one example of a reducing gearbox to provide fewer turns of driver 322 per rotations of motor 310.

It will be understood that with worm gear 320 or equivalent in assembly 300, the ability of assembly 300 to enable extraction of a line regardless of force applied by the user means the assembly will need to be rated to a maximum amount of force that can be expected to be applied by a user. Different motor sizing and different worm gears or both can be used to provide a desired rating. Worm gear 320 can be said to magnify the torque of drive assembly 300 at the rotational velocity output of drive 322. Magnification of the torque can allow the use of a motor rated for a lower torque, but that would prevent alteration of the rotational velocity of assembly 300 by a user.

Figure 4:
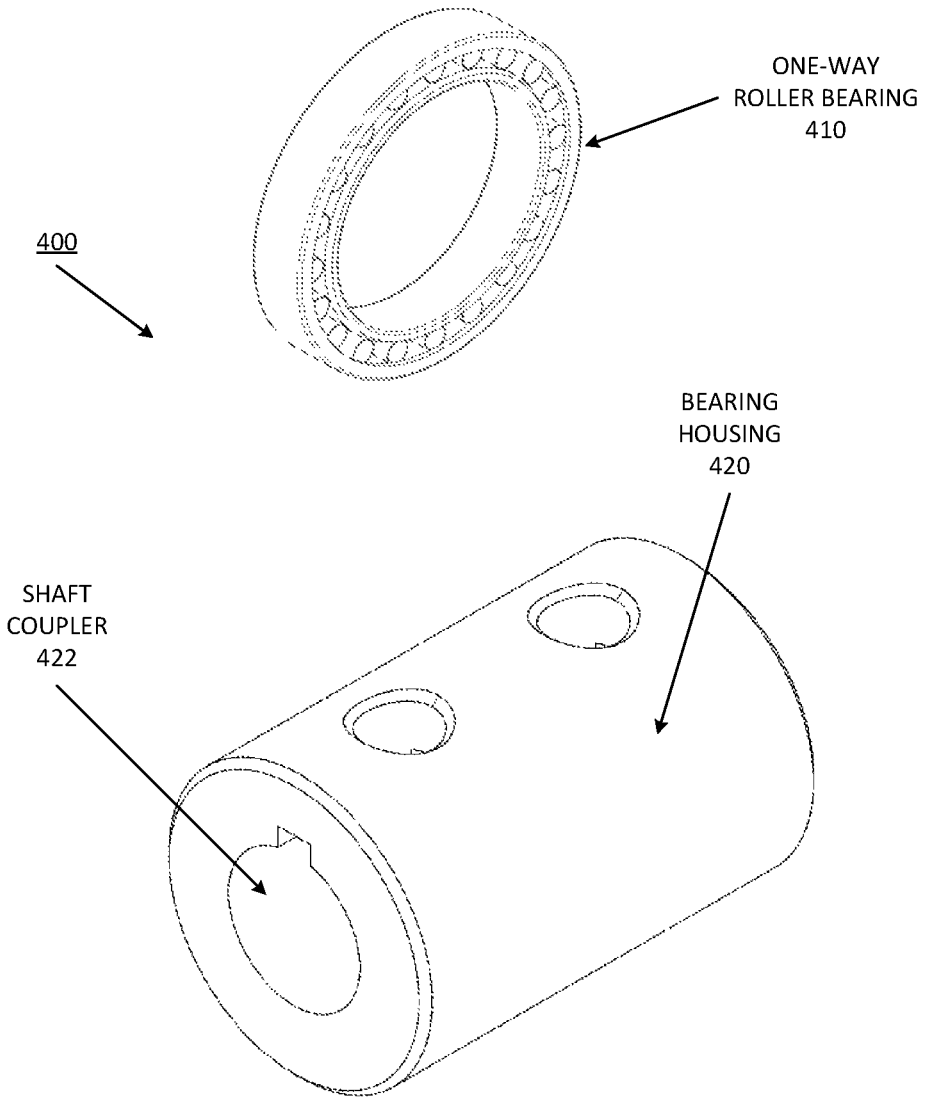
FIG. 4 is a representation of an embodiment of a ratcheting assembly for a resistance assembly that provides resistance via a constant velocity impeder.

FIG. 4 is a representation of an embodiment of a ratcheting assembly for a resistance assembly that provides resistance via a constant velocity impeder. Coupler 400 illustrates one example of a ratcheting device in accordance with an embodiment of assembly 100 of FIG. 1. In one embodiment, coupler 400 can be considered part of a drive assembly in accordance with assembly 300 of FIG. 3. Coupler 400 couples an impeder to a retraction assembly, such as retraction assembly 500 of FIG. 5.

Coupler 400 provides a ratcheting operation to couple the output of the impeder with the line to enable the impeder to drive rotation of a line in the direction of extraction, while still permitting the retraction assembly to retract the line unimpeded by the drive assembly or impeder. In one embodiment, coupler 400 includes one-way roller bearing 410, which can be housed in bearing housing 420. Housing 420 includes shaft coupler 422 to couple to the output of an impeder. In one embodiment, coupler 400 includes a ratcheting mechanism other than a one-way roller bearing. A one-way roller bearing permits free motion in one direction, but not in the other direction. The bearings spin freely in one direction, and catch in the other direction.

Figure 5:
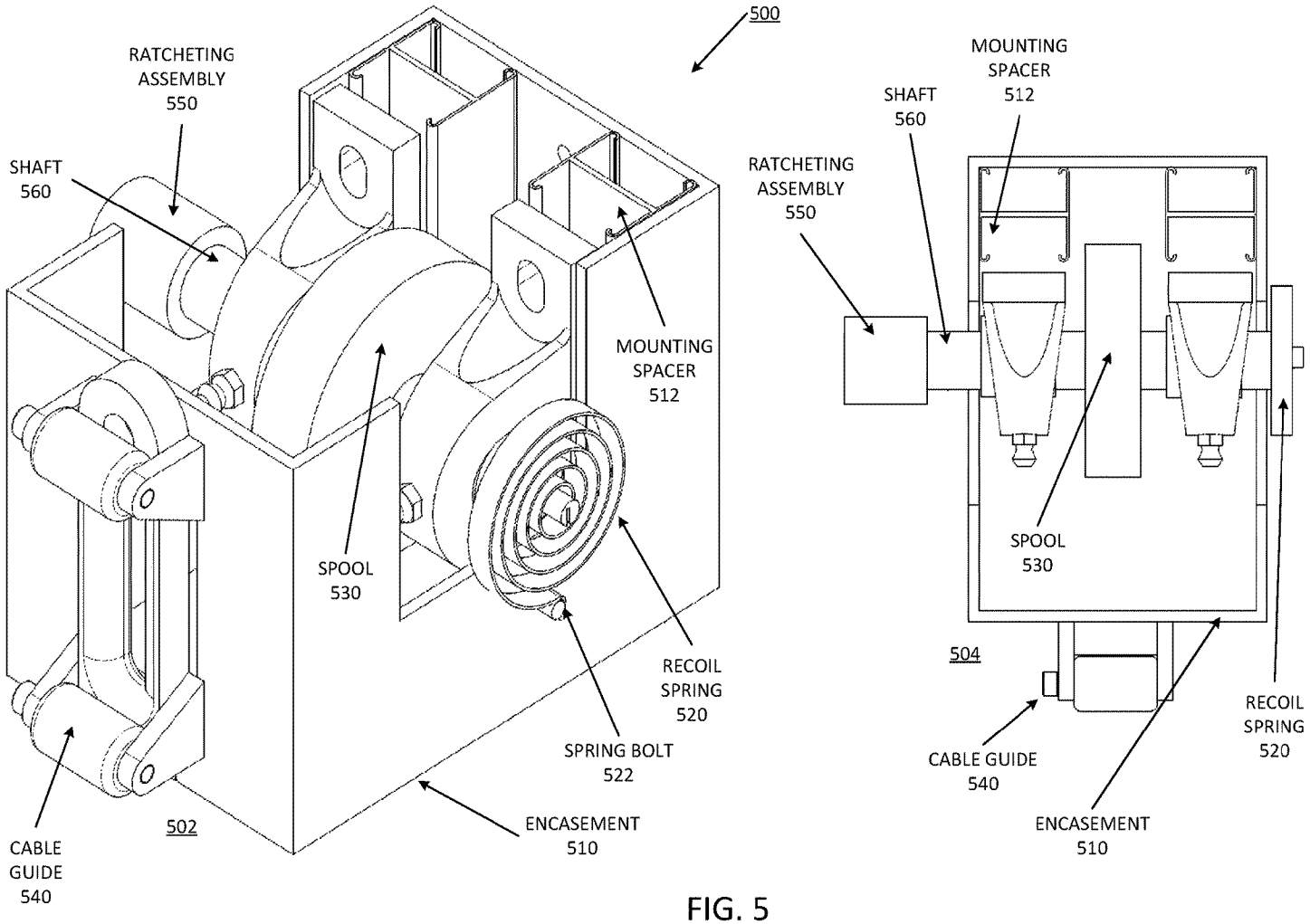
FIG. 5 is a representation of an embodiment of a retraction assembly for a resistance assembly that provides resistance via a constant velocity impeder.

FIG. 5 is a representation of an embodiment of a retraction assembly for a resistance assembly that provides resistance via a constant velocity impeder. Assembly 500 represents a retraction assembly in accordance with an embodiment of exercise equipment, such as in accordance with an embodiment of assembly 100 of FIG. 1. View 502 represents a side perspective view of assembly 500 in accordance with an embodiment described above. View 504 represents assembly 502 at a top view, looking down on the retraction assembly. Reference numerals and labels are repeated to show the different components from different perspectives.

In one embodiment, retraction assembly 500 includes encasement 510 to house the retraction assembly components. Encasement 510 can be any type of material and shape to allow the aggregation and function of the components. In one embodiment, encasement 510 includes one or more mounting spacers 512 as part of a mounting system for retraction assembly 500. In one embodiment, mounting of retraction assembly 500 mounts a complete exercise equipment assembly to a frame. In one embodiment, mounting spacer 512 is adjustable to permit different sizing or positioning or both of mounting to other equipment such as a frame.

Retraction assembly 500 includes spool 530 or equivalent mechanism to permit the retraction and winding of a line of exercise equipment, with the ability of the line to be extracted through the application of force by a user, and to automatically retract in the absence of the application of force by the user. Retraction assembly 500 includes recoil spring 520 or equivalent or other mechanism to cause retraction of the line in the absence of force exerted by the user. In one embodiment, retraction assembly 500 includes spring 520. In one embodiment, retraction assembly 500 includes a hanging counter weight to provide retractions. In one embodiment, retraction assembly 500 includes a motor with a clutch transmission to provide retraction. Such a motor could be coupled with a one-way coupler that allows motion in the direction of retraction, thus being opposite such a couple for the impeder.

In one embodiment, retraction assembly 500 includes recoil spring 520, which can be affixed to spring bolt 522. Spring bolt 522 provides tension in recoil spring 520. In one embodiment, spring bolt 522 permits adjustment to the tension of recoil spring 520. Adjustment to the tension can permit retraction assembly 500 to provide different levels of retraction based on user preference. The recoil apparatus can thus be adjusted to provide faster or slower retraction. Similar adjustment can be provided with other retraction mechanisms, such as increasing/decreasing counter weights, adjusting the speed of a retraction motor, or other variations.

Retraction assembly 500 illustrates ratcheting assembly 550, which is a coupler from an impeder. In one embodiment, ratcheting assembly 550 is a coupler in accordance with coupler 400 of FIG. 4. In one embodiment, ratcheting assembly 550 is considered part of retraction assembly 500. In one embodiment, ratcheting assembly 550 is considered part of the impeder or a drive assembly including the impeder. In either case, ratcheting assembly 550 couples between an impeder and the components that provide retraction of the line. As illustrated, ratcheting assembly 550 couples to shaft or axel 560, which extends through the retraction components. Alternatively to what is illustrated, ratcheting assembly 550 can indirectly couple to the retraction components (instead of directly via shaft 560), such as through a pulley system or gears or other mechanical interface.

In one embodiment, retraction assembly 500 includes cable guide 540. Cable guide 540 can include a mechanism to guide the line or cable into and out of encasement 510 to spool 530. In one embodiment, cable guide 540 includes metal rollers on ball bearings, which can handle pull and return from any direction.

FIG. 6 is a representation of an embodiment of a frame for a resistance training assembly that provides resistance via a constant velocity impeder, with pulleys to enable use of a workout bench. Exercise equipment 600 illustrates one embodiment of an application of an assembly in accordance with assembly 100 of FIG. 1, in which an impeder provides resistance through constant velocity. Equipment 600 is illustrated from three different views, with repeated reference numerals and descriptors for identification. View 602 represents a side perspective view of exercise equipment 600. View 604 represents a top view of exercise equipment 600. View 606 represents a "front" view looking at exercise equipment 600 from its common usage perspective.

Equipment 600 illustrates "blocks" to represent impeder 622 and retractor 624. Both components are intentionally left abstract as boxes to indicate that equipment 600 includes impeder 622 and retractor 624, which can be in accordance with any embodiment of an impeder or any embodiment of a retractor described herein. Line 626 mechanically couples to retractor 624 or to impeder 622 or to both. Retractor 624 retracts line 626 to an initial position, such as a spooled position when equipment 600 is in a starting state. When a user uses equipment 600, the user will extract line 626 in the course of exercising by the application of force. When a user ceases to apply the force, retractor 624 retracts line 626. Impeder 622 limits the speed of extraction to a velocity based on a rotational velocity of impeder 622. Regardless of the application of force by the user, line 626 cannot be extracted faster than the limit placed by the operation of impeder 622.

Equipment 600 illustrates bar 650, which a user can position for pushing or pulling or otherwise manipulating to apply resistance. In general, equipment 600 includes one or more handles for a user to use to exercise. A handle is intended to be understood broadly, and can include any one of bar 650, as well as a stirrup grip or other grip, a rope grip, a chain, a harness, or a combination. Bar 605 or other handle can start at an initial position of hanger hooks 614 or other position, which could include positions or frame extensions not specifically illustrated. Line 626 mechanically couples the handle such as bar 650 to impeder 622 or retractor 624 or both. In one embodiment, line 626 includes a cable. In one embodiment, line 626 includes a chain. In one embodiment, line 626 includes a strap. In one embodiment, line 626 includes a cord. Line 626 can be made of many different materials, such as rope, metallic cable, plastic, nylon or other synthetic fiber, or other materials. Line 626 should be rated for a comparable weight limit as impeder 622. For example, line 626 and impeder 622 can be rated for 1000 lbs.

In one embodiment, equipment 600 includes frame 610. Frame 610 can include vertical components as well as horizontal components. In general, frame 610 provides one or more initial positions for the handle, and a feed system to couple the handle with the impeder and retractor via line 626. Depending on a configuration system, which can include loop and hook, carabiners, pulleys, or other mechanisms, or a combination, line 626 can extend handle to one of a variety of starting positions or initial positions for an exercise. As illustrated, frame 610 supports various pulley positions 630, which can include actual pulleys with spinning guides, or can be passive passthrough areas, or a combination. Pulley positions 630 enable the feeding of line 626 or extensions of line 626 through mechanical coupling to other lines, to provide positioning and range of motion for one or more exercises. In one embodiment, frame 610 supports the repositioning of one or more pulleys. In one embodiment, equipment 600 includes frame 610 with repositionable pulleys to guide line 626 to one or more initial positions, and control motion starting position and possibly to control the range of motion. Thus, pulley positions 630 can be movable in one embodiment.

As illustrated, frame 610 includes frame base 612, which provides a stable mechanical structure to allow the feeding of line 626 to where exercises will be performed by a user. Many different frame systems are known with any of a variety of home gym solutions already in existence, or still to be made. In one embodiment, at least one such system can be retrofitted with impeder 622 and retractor 624 to operate as described herein with resistance provided by constant velocity. In one embodiment, systems in the same configuration can be made with impeder 622 and retractor 624 to operate as described herein with resistance provided by constant velocity.

While frame 610 is illustrated having a specific shape and style (for example, a shape to fit into a corner of a room), it will be understood that what is illustrated in one non-limiting example. Lines and handles can be mechanically coupled to each other and to an impeder or a retractor or both through designed arrangement of vertical and horizontal frame components, and through cables and pulleys to accomplish an exercise. In operation, a user of equipment 600 can initiate impeder 622 for operation. In one embodiment, either before or after initiating operation, the user can sets configuration preferences for impeder 622 or retractor 624 or pulley positions or other configuration or a combination. In one embodiment, impeder 622 spins at a constant velocity to drive an axel via a ratchet assembly. Retractor 624 can maintain the cable wound onto a spool, and the equipment will remain at rest until application of a force (e.g., pushing, pulling) by the user. Application of force by the user extracts line 626, at which point the ratchet engages and the spool can spin. The spool will not spin faster than the speed the motor allows, which means line 626 cannot be extracted from the spool any faster than the spool spins, which is based on the speed of impeder 622. Speed controlled unspooling provides the strain to the muscle group(s) as the muscles flex through the motion. As the user finishes the rep and releases the pull on line 626, the ratchet releases, the spool spins free, and the retractor 624 will recoil line 626 as slack is given by the user. The retraction provides a weightless extension of the muscle on the recoil. It will be understood that the user can again apply force once retractor 624 has fully retracted line 626, or has recoiled a portion of it.

If during a repetition the user stops, or pushes slower than the speed of impeder 622, the ratchet will release and retractor 624 will attempt to retractor line 626. In such a scenario, the user could hold the position, but the strain will be removed from the user, and the only resistance experienced will be the resistance of retractor 624 trying to retract line 626. Typically the retraction resistance will be very low compared to the resistance provided by impeder 622. In one embodiment, the retraction force is configurable. There are thus multiple ways in which equipment 600 allows a safe exercise experience for people of all abilities.

Figure 7:
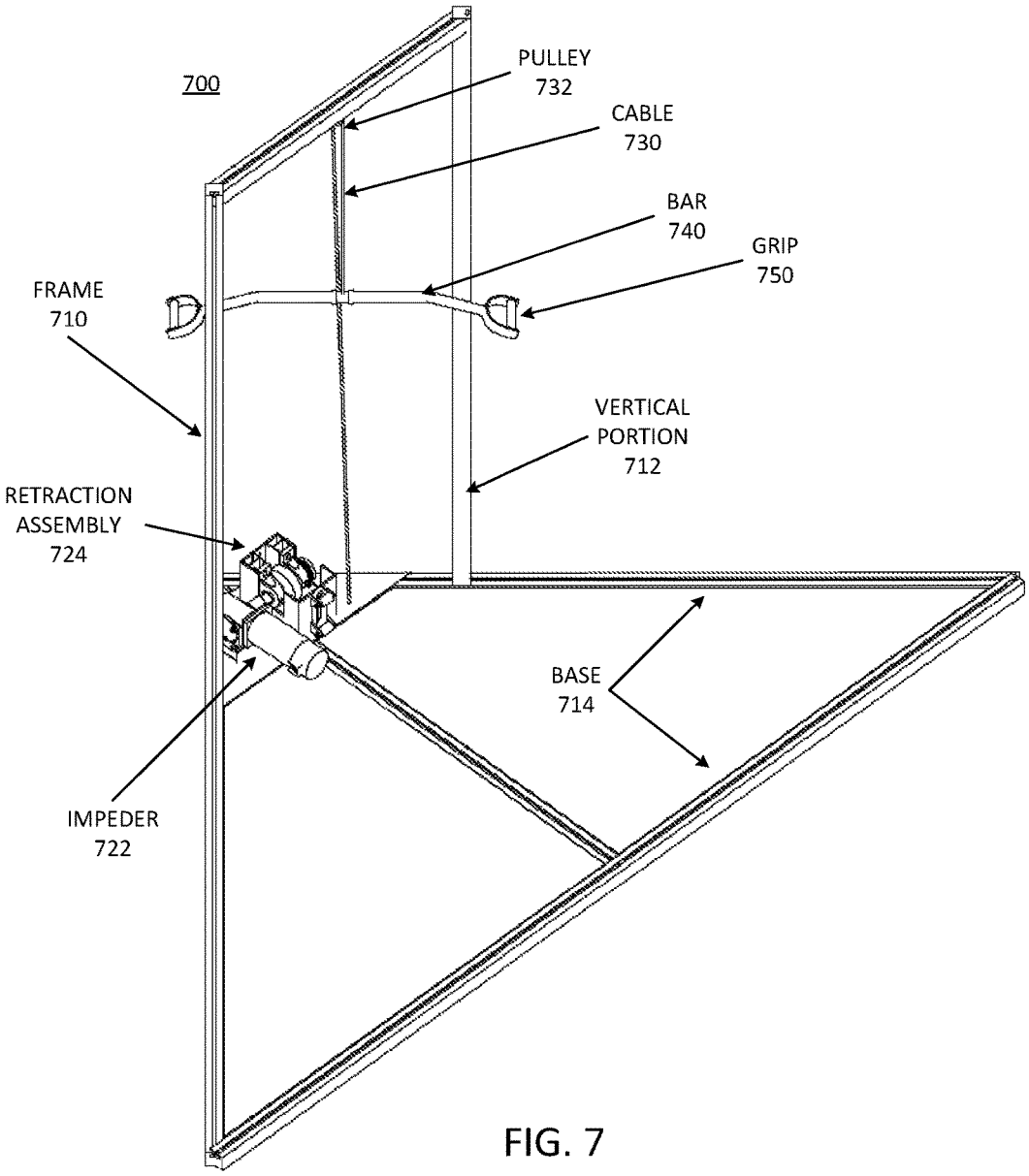
FIG. 7 is a representation of an embodiment of a frame for a resistance training assembly that provides resistance via a constant velocity impeder, with a bar with grips.

FIG. 7 is a representation of an embodiment of a frame for a resistance training assembly that provides resistance via a constant velocity impeder, with a bar with grips. Exercise equipment 700 provides one example of exercise equipment in accordance with an embodiment of assembly 100 of FIG. 1. Frame 710 represents a mechanical structure to guide one or more cables or lines 730 from impeder 722 and retraction assembly 724 to one or more initial starting points. Impeder 722 represents an impeder in accordance with any embodiment described herein. Retraction assembly 724 represents a retraction assembly in accordance with any embodiment described herein.

It will be understood that various pulleys or guides, hooks, loops, or other equipment or a combination can change the initial starting point or resting point for equipment 700. For example, in one embodiment, one pulley in equipment 700 can be the initial starting point for one exercise, and not be connected for another exercise which would have a different initial position. In one embodiment, equipment 700 is one example of exercise equipment in accordance with equipment 600 of FIG. 6. For example, equipment 700 can illustrate a different configuration for a different exercise than what is illustrated for equipment 600. The initial positions can be alternatives to each other. In one embodiment, different components are used at different initial positions. For example, a bar can be for one initial position, a stirrup for another, a harness for another, and so forth. The same component can be applied to multiple different initial positions.

Frame 710 includes vertical portion 712, which provides a framework to connect one or more lines and handles to enable a variety of exercises. Frame 710 includes base 714 to provide support at the ground level and provide a framework to connect one or more lines and handles to enable a variety of exercises, some of which may utilize lines connected to both vertical portion 712 and to base 714. In one embodiment, base 714 includes or is covered by a platform that provides an area for a user to exercise.

In one embodiment, frame 710 includes pulley 732 positioned to allow cable 732 to extend from retraction assembly 724 to a top bar of frame 710. In one embodiment, equipment 700 includes bar 740 coupled to cable 730. In one embodiment, bar 740 includes one or more grips 750. Alternatively, one or more grips (e.g., either individually or as an assembly) can couple directly to cable 730.

In one embodiment, impeder 722 includes a motor assembly. In one embodiment, impeder 722 includes a control module to control the operation of the motor assembly or impeder. Similar to what is discussed above, in one embodiment, impeder 722 and retraction assembly 724 can be coupled via a ratcheting assembly. For example, the ratchet can be mounted onto the shaft or axel of the motor assembly or impeder. The shaft can also be mounted to a spool in retraction assembly 724, which also includes a retraction apparatus such as a recoil spring. In one embodiment, retraction assembly 724 includes one or more mounting plates to mount to the retraction apparatus as well as to a cable guide or spool feed guide.

FIG. 8 is a representation of an embodiment of a speed control unit for a resistance training assembly that provides resistance via a constant velocity impeder. Control module 800 provides one example of a controller to use with a variable speed electronic impeder, in accordance with any embodiment of such an impeder herein. Control module includes control circuit 810, which can include a circuit board (e.g., printed circuit board, breadboard, or other circuit board) with control electronics. In one embodiment, control circuit 810 includes passive components. In one embodiment, control circuit 810 includes both active and passive components. Control nob 830 provides a user interface for a user to control operation of the impeder, such as by dialing the nob to adjust the constant rotational velocity up or down. In one embodiment, control nob 830 has an "off" position and analog control to control a speed setting. In one embodiment, control nob 830 has discrete or digital control. Control module 800 illustrates heatsink 820 for an embodiment where one or more electronic components of control circuit 810 is expected to heat up.

In one embodiment, with control module 810, a user can control the speed at which a line in exercise equipment can be extracted. Slower speeds allow for longer engagements of the muscles in each rep. Faster speeds allow for quicker bursts of exertion. The speed can be adjusted for user preference, or for different exercises, or both.

FIG. 9 is a representation of an embodiment of a resistance display for a resistance training assembly that provides resistance via a constant velocity impeder. Metering assembly 900 illustrates an embodiment of an inline load meter or inline scale 910 for use with an embodiment of exercise equipment as described herein. Inline scale 910 measures a load between its two endpoints or two mounting points. Connectors 950 represent cables, carabiners, hooks, or other mechanism used to mechanically couple inline scale 910 inline with a line coupled to a retraction assembly and impeder. Inline coupling refers to a configuration where inline scale 910 is coupled between the handle and the retraction assembly, with one end coupled to the handle, and the other end coupled to the retraction assembly. Commercial units are available.

Typical meters include display 920 to display the amount of weight applied between mounting points 940 (i.e., on the scale), and one or more controls 930. Controls 930 can provide a user the ability to set configurations (if available) for inline scale 910. Assembly 900 provides the ability to indicate an amount of tension or force or weight applied by a user. With such information, the user can monitor progress over time, such as what would typically be accomplished in a traditional gym by adding more weights to the bar. Thus, with metering assembly 900, a user can continue to have an idea how much force the user can apply, which would translate roughly to how much weight the user could lift or push.

Besides what is described herein, various modifications can be made to the disclosed embodiments and implementations of the invention without departing from their scope. Therefore, the illustrations and examples herein should be construed in an illustrative, and not a restrictive sense. The scope of the invention should be measured solely by reference to the claims that follow.

What is claimed is:

1. An apparatus, comprising:

a line mechanically coupled to a handle;

a retraction assembly mechanically coupled to the line to retract the line to an initial position, wherein the retraction assembly is coupled to rotate an axel with a retraction rotation; and an impeder mechanically coupled to the line to allow extraction of the line in a direction opposing retraction of the line, wherein the impeder includes a motor configured to drive the axel at a constant rotational velocity with an extraction rotation opposite the retraction rotation;

a torque magnification assembly including a worm gear to magnify the torque of the motor at the constant rotational velocity to prevent alteration of the rotational velocity by application of force by a user; and a one-way drive assembly including a one-way roller bearing to couple between the motor and the axel to cause the motor to drive the axel with the extraction rotation and permit the retraction assembly to rotate the axel with the retraction rotation to retract the line unimpeded by the drive assembly;

wherein the impeder is configured to constrain extraction of the line to the constant rotational velocity, to prevent extraction of the line faster than the constant rotational velocity, regardless of force applied by the user for extraction of the line.

2. The apparatus of claim 1, wherein the apparatus comprises a strength-training apparatus.

3. The apparatus of claim 1, wherein the handle comprises a bar or a stirrup grip.

4. The apparatus of claim 1, wherein the line comprises one of a cable, a chain, a strap, or a cord.

5. The apparatus of claim 1, wherein the retraction assembly comprises one of a spool controlled by a recoil spring, or a retraction motor having a one-way roller bearing.

6. The apparatus of claim 1, wherein the retraction assembly comprises one of a spring or a motor with a clutch transmission.

7. The apparatus of claim 1, wherein the motor further comprises a speed controller for the user to adjust the rotational velocity of the motor to cause the motor to drive the axel at a rotational velocity set by the user.

8. A strength training system, comprising:

a handle for a user to engage during use;

a line mechanically coupled to the handle;

a retraction assembly mechanically coupled to the line to retract the line to an initial position, wherein the retraction assembly is coupled to rotate an axel with a retraction rotation; and a motor assembly mechanically coupled to the line, the motor assembly including a motor configured to drive the axel at a constant rotational velocity, a torque magnification assembly including a worm gear to magnify the torque of the motor at the constant rotational velocity to prevent alteration of the rotational velocity by application of force by the user, and including a one-way drive assembly including a one-way roller bearing to drive in a rotation opposite retraction of the line to the initial position and permit the retraction assembly to retract the line unimpeded by the drive assembly, wherein the drive assembly is configured to constrain extraction of the line to the constant rotational velocity, to prevent extraction of the line from the initial position faster than the constant rotational velocity by a force of the user; and a frame including one or more repositionable pulleys to guide the line to the initial position.

9. The strength training system of claim 8, the frame further comprising one or more of an additional pulley to guide the line to an alternate initial position, or a line extension to extend the line to an alternate initial position.

10. The strength training system of claim 9, wherein the handle comprises a bar in one initial position and a stirrup grip in a second initial position.

11. The strength training system of claim 8, wherein the line comprises one of a cable, a chain, a strap, or a cord.

12. The strength training system of claim 8, wherein the retraction assembly comprises a spool controlled by a recoil spring.

13. The strength training system of claim 8, wherein the motor assembly further comprises a speed controller for the user to adjust the rotational velocity of the motor to cause the motor to drive the axel at a rotational velocity set by the user.

* * * * *